US006034038A

United States Patent [19]

Lockwood et al.

[11] Patent Number: 6,034,038

[45] **Date of Patent: *Mar. 7, 2000**

[54] LUBRICANT ADDITIVE FORMULATION

[75] Inventors: Frances E. Lockwood, Georgetown; Richard Joseph Baumgart, Ashland; Michael Andrew Dituro, Huntington, all of Ky.

[73] Assignee: Ashland Inc., Lexington, Ky.

[ * ] Notice: This patent is subject to a terminal disclaimer.

[21] Appl. No.: 08/836,083

[22] PCT Filed: Nov. 3, 1995

[86] PCT No.: PCT/US95/14186

§ 371 Date: Aug. 27, 1997

§ 102(e) Date: Aug. 27, 1997

[87] PCT Pub. No.: WO96/15211

PCT Pub. Date: May 23, 1996

[51] Int. Cl.[7] ..... C10M 131/04; C10M 141/04

[52] U.S. Cl. ..... 508/183; 508/181

[58] Field of Search ..... 508/183, 181

[56] References Cited

U.S. PATENT DOCUMENTS

| | | | |
|---|---|---|---|
| 4,333,840 | 6/1982 | Reick | 252/16 |
| 4,349,444 | 9/1982 | Reick | 252/16 |
| 4,857,220 | 8/1989 | Hashimoto | 252/56 R |
| 4,859,352 | 8/1989 | Waynick | 252/41 |
| 5,356,547 | 10/1994 | Arai et al. | 252/46.4 |
| 5,641,731 | 6/1997 | Baumgart et al. | 508/183 |
| 5,763,369 | 6/1998 | Baumgart et al. | 508/183 |

FOREIGN PATENT DOCUMENTS

| | | |
|---|---|---|
| 0 304 011 A1 | 2/1989 | European Pat. Off. . |
| 0 452 998 A2 | 10/1991 | European Pat. Off. . |

*Primary Examiner*—Ellen M. McAvoy
*Attorney, Agent, or Firm*—Carrithers Law Office; David W. Carrithers

[57] ABSTRACT

A lubricant additive formulation for addition to conventional motor oil to improve the lubricating properties of the engine oil and enhance the performance of the engine. The engine treatment oil additive comprises a synergistic blend of an oil soluble molybdenum additive, polyalphaolefin, ester such as a polyolester or diester, polytetrafluoroethylene, dispersant inhibitor containing zinc dithiophosphate, mineral oil base stock, viscosity index improvers, and borate ester used in combination with a conventional crankcase lubricant at about a 20 to about a 25% volume/percent. The improved performance of the engine additive in comparison with a conventional crankcase lubricants is attributable to the effect of optimizing the design parameters for each of the individual chemical constituents and combining the chemical constituents according to the present invention to obtain surprisingly good results including improved wear, oxidation resistance, viscosity stability, engine cleanliness, fuel economy, cold starting, and inhibition of acid formation.

50 Claims, 6 Drawing Sheets

TOTAL ADJUSTED BEARING WEIGHT LOSS, mg
M.O. = API SG 5W-30 MOTOR OIL
ADDITIVE = SYNERGISTIC 7 COMPONENT ADDITIVE BLEND PLUS BORATE ESTER

LUBRICANT ADDITIVE FORMULATION

TECHNICAL FIELD

The invention relates to the general field of additives to improve the performance oflubricating oils and function as an engine treatment oil additive. The preferred embodiment of the present invention comprises a synergistic combination of chemical constituents including an oil soluble molybdenum additive, polyalphaolefin, ester such as a diester or polyolester, polytetrafluoroethylene, dispersant inhibitor containing zinc dithiophosphate, mineral oil base stock, viscosity index improvers, and borate ester compound used in combination with a conventional crankcase lubricant at about a 20 to about a 25% volume/percent.

DESCRIPTION OF THE PRIOR ART

Lubrication involves the process of friction reduction, accomplished by maintaining a film of a lubricant between surfaces which are moving with respect to each other. The lubricant prevents contact of the moving surfaces, thus greatly lowering the coefficient of friction. In addition to this function, the lubricant also can be called upon to perform heat removal, containment of contaminants, and other important functions. Additives have been developed to establish or enhance various properties of lubricants. Various additives which are used include viscosity improvers, detergents, dispersants, antioxidants, extreme pressure additives, corrosion inhibitors.

Anti-wear agents, many of which function by a process of interactions with the surfaces, provide a chemical film which prevents metal-to-metal contact under high load conditions. Wear inhibitors which are useful under extremely high load conditions are frequently called "extreme pressure agents". Certain of these materials, however, must be used judiciously in certain applications due to their property of accelerating corrosion of metal parts, such as bearings. The instant invention utilizes the synergy between several chemical constituents to provide an additive formula which enhance the performance of conventional engine oil and inhibits the undesirable side effects which may be attributable to use of one of more of the chemical constituents when used at particular concentrations.

Several references teach the use of individual chemical components to enhance the performance of conventional engine oil. For instance, U.S. Pat. No. 4,879,045 by Eggerichs adds lithium soap to a synthetic base oil comprising diester oil and polyalphaolefins which can comprise an aliphatic diester of a carboxylic acid such as di-2-ethylhexylazelate, di-isodecyladipate, or ditridecyladipate, as set forth in the *Encyclopedia of Chemical Technology,* 34th addition, volume 14, pp 477–526, which describes lubricant additives including detergent-dispersant, viscosity index (VI) improvers, foam inhibitors, and the like.

Numerous articles discuss various methods of adding polytetrafluoroethylene (PTFE) to lubricating oils and greases, primarily as external lubricants. However, the synergistic combination of chemical constituents of the present invention are not disclosed by any known prior art references. Moreover, a search in an electronic database of U.S. patents since about 1972 discloses no patents mentioning PTFE (or polytetrafluoroethylene) molybdenum (Mo) and diester in the same paragraph such as is taught and claimed in the instant application.

U.S. Pat. No. 4,333,840 to Reick teaches a hybrid PFTE lubricant and describes an optional addition of a molybdenum compound in a carrier oil. It uses a carrier oil diluted by a synthetic lubricant of low viscosity in order to provide a viscosity that is "acceptable in weapons applications". The formulations are suggested for lubricating skis, weapons; however, there is no suggestion that they are applicable to lubrication of internal combustion engines in combination with the constituents of the present claimed invention.

Furthermore, U.S. Pat. No. 4,615,917 and U.S. Pat. No. 4,608,282 by Runge teach blending sintered fluoropolymer (e.g., PTFE) with solvents which evaporate to leave a thin film when the formulation is sprayed or applied as a grease to a metal surface, e.g., boat hulls, aircraft, dissimilar metals.

SUMMARY OF THE INVENTION

A motor oil performance-enhancing engine treatment oil additive formulated for addition to conventional motor oil to improve the lubricating properties of the engine oil and enhance the performance of the engine.

The preferred embodiment of the engine treatment oil additive comprises a synergistic blend of at least eight chemical constituents including an oil soluble molybdenum additive, polyalphaolefin, ester such as a diester or polyolester, polytetrafluoroethylene, dispersant inhibitor containing zinc dithiophosphate, mineral oil base stock, viscosity index improvers, and borate ester compound, wherein the engine treatment oil additive is used in combination with a conventional crankcase lubricant at about a 20 to about a 25% volume/percent. An alternate embodiment of the invention comprises a synergistic blend of at least seven chemical constituents including an oil soluble molybdenum additive, polyalphaolefin, diester, polytetrafluoroethylene, dispersant inhibitor containing zinc dithiophosphate, mineral oil base stock, and viscosity index improvers, wherein the engine treatment oil additive is used in combination with a conventional crankcase lubricant at about a 20 to about a 25% volume/percent. The improved performance of the engine additive in comparison with conventional crankcase lubricants is attributable to the synergistic effect of optimizing the design parameters for each of the individual chemical constituents and combining the chemical constituents to obtain surprisingly good results including improved: wear, oxidation resistance, viscosity stability, engine cleanliness, fuel economy, cold starting, and inhibition of acid formation. The novel engine additive formulation comprises a synergistic combination of compounds, ingredients, or components, each of which alone is insufficient to give the desired properties, but when used in concert give outstanding lubricating properties. Additional components may be added to the engine additive formulation to enhance specific properties for special applications. Moreover, the formulation is compatible with engine warranty requirements, i.e., service classification API SH.

The lubricating and oil-based functional fluid compositions of the present invention are based on natural and synthetic lubricating oils and mixtures thereof in combination with the additives.

The individual components can be separately blended into the base fluid or can be blended therein in various subcombinations. Moreover, the components can be blended in the form of separate solutions in a diluent. It is preferable, however, to blend the components used in the form of an oil additive concentrate as this simplifies the blending operations, reduces the likelihood of blending errors, and takes advantage of the compatibility and solubility characteristics afforded by the overall concentrate.

These lubricating compositions are effective in a variety of applications including crankcase lubricating oils for spark-ignited and compression-ignited internal combustion engines, two-cycle engines, aviation piston engines, marine and low-load diesel engines, and the like. The invention will find use in a wide variety of lubricants, including motor oils, greases, sucker-rod lubricants, cutting fluids, and even spray-tube lubricants. The invention has the multiple advantages of saving energy, reducing engine or other hardware maintenance and wear, and therefore, provides an economical solution to many lubricating problems commonly encountered in industry or consumer markets. It is also contemplated that the formulation may be applicable to automatic transmission fluids, transaxle lubricants, gear lubricants, hydraulic fluids, and other lubricating oil compositions which can benefit from the incorporation of the compositions of the instant invention.

The motor oil performance-enhancing engine treatment oil additive formulated for addition to conventional motor oil for improving the lubricating properties of the motor oil and enhancing the performance of the engine comprises the following chemical constituents: An oil soluble molybdenum additive, such as MOLYVAN 855, manufactured by VANDERBILT CHEMICAL; a ("Synthetic") polyalphaolefin (PAO) having a viscosity of about 4 cSt; a PAO having a range of about 6 cSt and/or a synthetic diester, such as for example, Chemaloy M-22A; a polytetrafluoroethylene, ("PTFE"), colloidal dispersed product, such as is manufactured by ACHESON CHEMICAL; a Dispersant Inhibitor (DI) package containing zinc dithiophosphate (ZDP), such as CHEMALOY D-036; a Mineral Oil Base Stock; and a Viscosity Index Improver (VI), such as for example, (SHELLVIS 90-SBR); and a borate ester into a package for addition to conventional motor oil results in an engine treatment additive exhibiting surprising improvement in engine wear, oxidation resistance, viscosity stability, engine cleanliness, fuel economy, cold starting ability, and inhibition of acid formation.

It has been discovered that, when added to the crankcase of an internal combustion, e.g., spark ignition (SI) engine at most preferably approximately 20–25 vol. % with the conventional crankcase lubricant, the engine treatment oil additive of the instant application provides synergistic performance improvement of both the oil and the engine. The formulation is compatible with engine warranty lubrication requirements, i.e., service classification API SH.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENT

Figure 1:
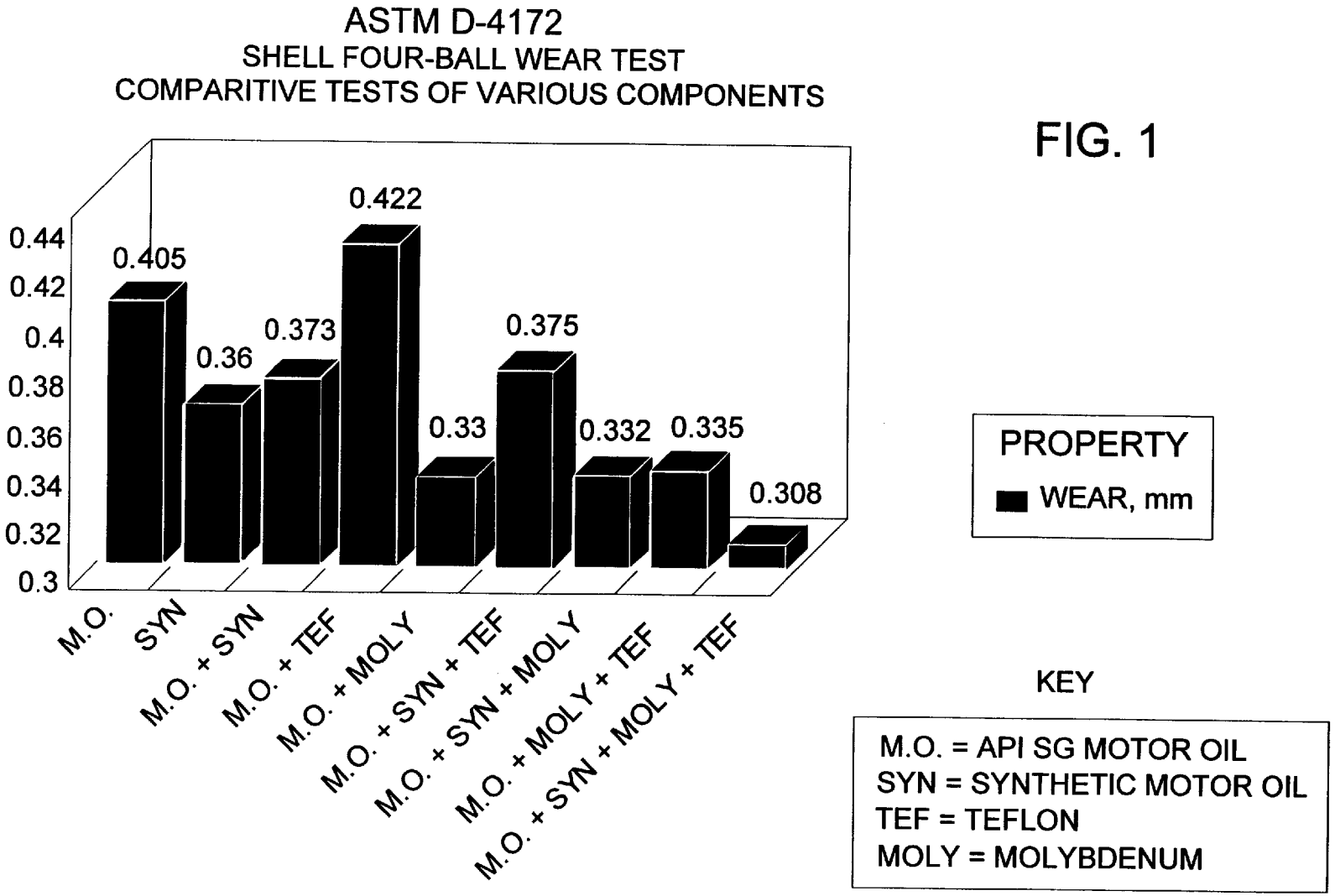
FIG. 1 is a bar chart of ASTM D4172 four-ball wear results versus lube compositions.

Each of the preferred ingredients of the synergistic engine treatment oil additive formulation, whether mandatory or optional, is discussed below:

SYNTHETICS

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(l-octenes), poly(1-decenes), etc., and mixtures thereof; alkylbenzenes (e.g., dodecylbenzenes, tetradecylbenzenes, dinonylbenzenes, di-(2-ethylhexyl) benzenes, etc.); polyphenyls (e.g., biphenyls, terphenyls, alkylated polyphenyls, etc.), alkylated diphenyl, ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic oils. These are exemplified by the oils prepared through polymerization of ethylene oxide or propylene oxide, the alkyl and aryl ethers of these polyoxyalkylene polymers (e.g., methylpolyisopropylene glycol either having an average molecular weight of 1000, diphenyl either of polyethylene glycol have a molecular weight of 500–1000, diethyl ether of polypropylene glycol having a molecular weight of 1000–1500, etc.) or mono- and polycarboxylic esters thereof, for example, the acetic acid esters, mixed $C_3$-C-$_8$ fatty acid esters, esters, or the $C_{13}$0×0 acid diester of tetraethylene glycol.

Another suitable class of synthetic oils comprises the esters of dicarboxylic acids (e.g., phtalic acid, succinic acid, alkyl succinic acids and alkenyl succinic acids, maleic acid, azelaic acid, suberic acid, sebacic acid, fumaric acid, adipic acid, alkenyl malonic acids, etc.) with a variety of alcohols (e.g., butyl alcohol, hexyl alcohol, dodecyl alcohol, 2-ethylhexyl alcohol, ethylene glycol diethylene glycol monoether, propylene glycol, etc.). Specific examples of these esters include dibutyl adipate, di(2-ethylhexyl) sebacate, di-hexyl fumarate, dioctyl sebacate, diisooctyl azelate, diisodecyl azealate, dioctyl phthalate, didecyl phthalate, dicicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl, polyalkoxy-, or polyaryloxy-siloxane oils and silicate oils comprise another useful class of synthetic oils [e.g., tetraethyl silicate, tetraisopropyl silicate, tetra-(2-ethylhexyl) silicate, tetra-(4-methyl-2-ethylhexyl) silicate, tetra-(p-tert-butylphenyl silicate, hexyl-(4-methyl-2-pentoxy) disiloxane, poly(methyl) siloxanes, poly(methylphenyl) siloxanes, etc.]. Other synthetic oils include liquid esters of phosphorus-containing acids (e.g., tricresyl phosphate, trioctyl phosphate, diethyl ester of decylphosphonic acid, etc.), polymeric tetrahydrofurans and the like.

Preferably from about 10 to about 95, more preferably to about 25 to about 90, and most preferably to about 60 to about 85% by volume of the synthetics, which may be either polyalphaolefins, polyesters or mixtures thereof, will be employed in the formulations of the present invention. Formulations with those percentages will be used in a typical bottled concentrate for adding to the conventional oil in a crankcase.

Esters

The most preferred synthetic based oil ester additives are polyolesters and diesters such as di-aliphatic diesters of alkyl carboxylic acids such as di-2-ethylhexylazelate, di-isodecyladipate, and di-tridecyladipate, commercially available under the brand name EMERY 2960 by EMERY CHEMICALS, described in U.S. Pat. No. 4,859,352 to Waynick. Other suitable polyolesters are manufactured by MOBIL OIL. MOBIL POLYOLESTER P-43 and HATCO CORP 2939 are particularly preferred.

Diesters and other synthetic oils have been used as replacements of mineral oil in fluid lubricants. Diesters have outstanding extreme low temperature flow properties and good residence to oxidative breakdown.

The diester oil may include an aliphatic diester of a dicarboxylic acid, or the diester oil can comprise a dialkyl aliphatic diester of an alkyl dicarboxylic acid, such as di-2-ethyl hexyl azelate, di-isodecyl azelate, di-tridecyl azelate, di-isodecyl adipate, di-tridecyl adipate. For instance, Di-2-ethyl hexyl azelate is commercially available under the brand name of Emery 2958 by Emery Chemicals.

Polyalphaolefin (PAO)

Polyalphaolefin, ("PAO"), is a synthetic fluid effective at high temperatures, such as occurs during operation of internal combustion engines. It is also very effective at low temperatures. It is especially effective in the presence of diesters. Polyalphaolefin provides superior oxidation and hydrolytic stability and high film strength. Polyalphaolefin also has a high molecular weight, higher flash point, higher fire point, lower volatility, higher viscosity index, and lower pour point than mineral oil. U.S. Pat. No. 4,859,352 hereby incorporated by reference provides additional polyalphaolefin derivatives.

Preferred polyalphaolefins, ("PAO"), include those sold by MOBIL CHEMICAL COMPANY as SHF fluids and those sold by Ethyl Corporation under the name ETHYLFLO, or ("ALBERMARLE"). PAO's include the ETHYL-FLOW series by ETHYL CORPORATION, "ALBERMARLE CORPORATION", including ETHYL-FLOW 162, 164, 166, 168, and 174, having varying viscosities from about 2 to about 460 centistoke. Also useful are blends of about 56% of the 460 centistoke product and about 44% of the 45 centistoke product as set forth in U.S. Pat. No. 5,348,668 hereby incorporated by reference.

MOBIL SHF-42, from MOBIL CHEMICAL COMPANY, EMERY 3004 and 3006, and QUANTUM CHEMICAL COMPANY provide additional polyalphaolefins base stocks. For instance, EMERY 3004 polyalphaolefin has a viscosity of 3.86 centistokes (cSt) at 212 F. (100 C.) and 16.75 cSt at +104 F. (40 C.). It has a viscosity index of 125 and a pour point of −98 F and it also has a flash point of +432 F. and a fire point of +478 F. Moreover, EMERY 3006 polyalphaolefin has a viscosity of 5.88 cSt at +212 F. and 31.22 cSt at +104 F. It has a viscosity index of 135 and a pour point of −87 F. It also has a flash point of +464 F. and a fire point of +514 F. It has a molecular weight of 1450, a flash point of +550 F., and a fire point of +605 F.

Additional satisfactory polyalphaolefins are those sold by Uniroyal Inc. under the brand SYNTON PAO-40, which is a 40 centistoke polyalphaolefin. Also useful are the Oronite brand polyalphaolefins manufactured by Chevron Chemical Company.

It is contemplated that GULF SYNFLUID cSt PAO, commercially available from GULF OIL CHEMICALS COMPANY, a subsidiary of CHEVRON CORPORATION, which is similar in many respects to EMERY 3004, may also be utilized herein. MOBIL SHF-41 PAO, commercially available from MOBIL CHEMICAL CORPORATION, is also similar in many respects to EMERY 3004.

Preferably the polyalphaolefins will have a viscosity in the range of about 2–10 centistoke at 100° C. with viscosities of 4 and 6 centistoke being particularly preferred.

Diesters and Polyalphaolefins Mixtures

Particularly preferred synthetic-based stocks are mixtures of diesters with polyalphaolefins. Also useful are polyol esters such as EMERY 2935, 2936, and 2939, from EMERY GROUP of HENKEL CORPORATION, and HATCO 2352, 2962, 2925, 2938, 2939, 2970, 3178, and 4322 polyol esters from HATCO CORPORATION, described in U.S. Pat. No. 5,344,579 to Ohtani et al. MOBIL ester P24 from MOBIL CHEMICAL COMPANY. MOBIL esters such as made by reacting dicarboxylic acids, glycols, and either monobasic acids or monohydric alcohols like EMERY 2936 synthetic-lubricant base stocks from QUANTUM CHEMICAL CORPORATION and MOBIL P24, from MOBIL CHEMICAL COMPANY can be used.

Polyol esters are another type of synthetic oil having good oxidation and hydrolytic stability. The polyol ester for use herein preferably has a pour point of about −100° C. or lower to −40° C. and a viscosity of about 2–460 centistoke at 100° C.

Dispersant Inhibitor (DI)

Though not narrowly critical, the Dispersant Inhibitor ("DI"), is exemplified by those which contain alkyl zinc dithiophosphates, succinimide, or MANNICH dispersants; calcium, magnesium, sulfonates, sodium sulfonates, phenolic and amine antioxidants, plus various friction modifiers such as sulfurized fatty acids. Dispersant inhibitors are readily available from LUBRIZOL, ETHYL, ORONITE, a division of CHEVRON CHEMICAL, and PARAMAINS, a division of EXXON CHEMICAL COMPANY.

Generally acceptable are those commercial detergent inhibitor packages used in formulated engine oils meeting the API SHCD performance specifications. Particularly preferred are LUBRIZOL 8955, ETHYL HITEC 1111, and 1131, and similar formulations available from PARAMAINS, a division of EXXON CHEMICAL, or ORONITE, a division of CHEVRON CHEMICAL.

Concentration of DI will probably be in the range of about 0.5–35, more preferably 1.0–25, and most preferably 5–20% by volume of the total formulation. Concentrations in concentrates produced for dilution will generally be these ranges.

Zinc dithiophosphate also functions as a corrosion inhibitor, antiwear agent, and antioxidants added to organic materials to retard oxidation.

Other metal dithiophosphates such as zinc isopropyl, methylamyl dithiophosphate, zinc isopropyl isooctyl dithiophosphate, barium di(nonyl) dithiophosphate, zinc di(cyclohexyl) dithiophosphate, copper di(isobutyl)

dithiophosphate, calcium di(hexyl) dithiophosphate, zinc isobutyl isoamyl dithiophosphate, and zinc isopropyl secondary-butyl dithiophosphate may be applicable. These metal salts of phosphorus acid esters are typically prepared by reacting the metal base with the phosphorus acid ester such as set forth in U.S. Pat. No. 5,354,485 hereby incorporated by reference.

Viscosity Index Improver (VI)

Viscosity improvers, ("VI"), include, but are not limited to, polyisobutenes, polymethacrylate acid esters, polyacrylate acid esters, diene polymers, polyalkyl styrenes, alkenyl aryl conjugated diene copolymers, polyolefins and multifunctional viscosity improvers and SHELLVIS 90, a styrene-butadiene rubber in mineral oil base.

Preferably the viscosity improvers will constitute 0.05–5, more preferably 0.07–3, and most preferably 0.1–2 wt. % of the crankcase motor oil.

Mineral Oil Base Stock

Particularly preferred as mineral oil base stocks are the VALVOLINE 325 NEUTRAL, and 100 NEUTRAL, manufactured by the VALVOLINE Division of ASHLAND INC., Inc., and by others.

Other acceptable petroleum-base fluid compositions include white mineral, paraffinic and MVI naphthenic oils having the viscosity range of about 20–400 Centistoke. Preferred white mineral oils include those available from WITCO CORPORATION, ARCO CHEMICAL COMPANY, PSI, and PENRECO. Preferred paraffinic oils include solvent neutral oils available from EXXON CHEMICAL COMPANY, HVI neutral oils available from SHELL CHEMICAL COMPANY, and solvent treated neutral oils available from ARCO CHEMICAL COMPANY. Preferred MVI naphthenic oils include solvent extracted coastal pale oils available from EXXON CHEMICAL COMPANY, MVI extracted/acid treated oils available from SHELL CHEMICAL COMPANY, and naphthenic oils sold under the names HYDROCAL and CALSOL by CALUMET, and described in U.S. Pat. No. 5,348,668 to Oldiges.

Mineral oil base stock will comprise preferably 5–95, more preferably 65–90 and most preferably 75–80 by volume in the motor oil, but is not narrowly critical.

Molybdenum Additive

The most preferred molybdenum additive is an oil-soluble decomposable organo molybdenum compound, such as MOLYVAN 855. In general, the organo molybdenum compounds are preferred because of their superior solubility and effectiveness.

A less effective alternative molybdenum additive is MOLYVAN L is sulfonated oxymolybdenum dialkyldithiophosphate described in U.S. Pat. No. 5,055,174 by Howell hereby incorporated by reference.

MOLYVAN A made from R.T. VANDERBILT COMPANY Inc., New York, N.Y., USA, is also an alternative additive which contains about 28.8 wt. % MO, 31.6 wt. % C, 5.4 wt. % H., and 25.9 wt. % S. Also useful are MOLYVAN 855, 822, 856, and 807 in decreasing order of preference.

Also useful is SAKURA LUBE-500, which is more soluble Mo dithiocarbamate containing lubricant additive obtained from ASAHI DENKI CORPORATION and comprised of about 20.2 wt. %MO, 43.8 wt. %C, 7.4 wt. %H, and 22.4 wt. %S.

Also useful is MOLYVAN 807, a mixture of about 50 wt. % molybdenum ditridecyldithyocarbonate, and about 50 wt. % of an aromatic oil having a specific gravity of about 38.4 SUS and containing about 4.6 wt. % molybdenum, also manufactured by R.T. VANDERBILT and marketed as an antioxidant and antiwear additive.

Other sources are molybdenum $Mo(Co)_6$, and Molybdenum octoate, $MOO(C_7H_{15}CO_2)_2$ containing about 8 weight-% Mo marketed by ALDRICH CHEMICAL COMPANY, Milwaukee, Wis. and molybdenum naphthenethioctoate marketed by SHEPHARD CHEMICAL COMPANY, Cincinnati, Ohio.

Inorganic molybdenum compounds such as molybdenum sulfide and molybdenum oxide are substantially less preferred than the organic compounds as described in 855, 822, 856, and 807. Most preferred are organic thio and phospho compounds such as those typified by the VANDERBILT and other molybdenum compounds described specifically above are alternative selections.

The preferred dosage in the total lubricant is from about 0.05 to about 5% by weight, more preferably from about 0.07 to about 3% by weight, and most preferably of from about 0.1–2% by weight Mo.

Functional Additives

Oil soluble functional additives may include certain solid lubricants such as molybdenum and polytetrafluoroethylene. The term "oil soluble" water-insoluble functional additive refers to a functional additive which is not soluble in water above a level of about 1 gram per 100 ml of water at 25 C., but is soluble in mineral oil to the extent of at least 1 gram per liter at 25 C.

These functional additives can also include frictional polymer formers, which are polymer forming materials which are dispersed in a liquid carrier at low concentration and which polymerize at rubbing or contacting surfaces to form protective polymeric films on the surfaces. The polymerization are believed to result from the heat generated by the friction and, possibly, from catalytic and/or chemical action of the freshly exposed surface.

Mixtures of two or more of any of the afore-described functional additives can also be used.

PTFE (polytetrafluoroethylene)

It is theorized that polytetrafluoroethylene, ("PTFE"), containing lubricants provide enhanced lubrication by virtue of the fact that the PTFE particles somehow become attached to the surfaces of the engine thus lubricated, thereby creating a renewable coating of PTFE. The composition may contain a mixture of a carrier lubricant medium, such as mineral oil, a quantity of fluoropolymer particles, such as ground and sintered particles of polytetrafluoroethylene which are well dispersed in the carrier lubricant. It is important that these particles are well dispersed in the carrier lubricant in order to prevent coagulation, agglomeration, and/or settling.

Incorporation of minute solid fluoropolymer particles, such as polytetrafluoroethylene, ("PTFE"), in liquid lubricants. U.S. Pat. No. 3,933,656 to Reick, incorporated herein by reference, teaches a modified lubricant for an internal combustion engine which comprises a major amount of a conventional motor oil, with a minor amount of sub-micron size PTFE particles, and a neutralizing agent to stabilize the dispersion to prevent agglomeration and coagulation of the particles. However, Reich formula incorporating phosphate compounds in combination with molybdenum is very corrosive in contrast to the molybdenum compound used in the formulation of the present invention.

The submicron size particles of PTFE are available such as duPont "TEFLON" aqueous dispersions T-42 and T-30 whose particle sizes are in the 0.5 to 0.05 micron range or equivalent products. It is contemplated that "Fluon" ADO 38 TFE colloidal dispersion manufactured by ICI (Imperial Chemical Industries, Ltd.) would also provide an acceptable PTFE particle base.

As described in U.S. Pat. No. 4,613,917, hereby incorporated by reference, the particles of a fluoropolymer may be ground and sintered particles of polytetrafluoroethylene (PTFE). Ground particles may be used because of their durability and because their inertness and electrostatic neutrality, the latter characteristics being important in keeping the particles from agglomerating. In addition, the particles may be sintered because sintered PTFE particles typically have a smoother surface an a more uniform geometry than non-sintered particles.

The size of the PTFE particles is selected in consideration that the PTFE particles actually become attached within the pores of the surface thus coated. The frictional forces applied by the moving parts of the engine wipe after the composition is applied to it removing excess lubricant and working the lubricant into the surface by the exertion of heat and pressure to the surface to enhance penetration of the lubricant into the surface. Thus, it is thought that the PTFE is attached to the surface, and particularly within the pores of the surface.

It is thought that the other additives in the additive package aid in bonding of the PTFE particles to the surface lowering the coefficient of friction of the surface and reducing fluid drag on the surface. For instance, U.S. Pat. No. 4,333,840 suggest that in the case of steel for firearms having metals which resist the surface impregnation by PTFE particles, the inclusion of a molybdenum compound with a surfactant aids in the possible the formation thereon of a PTFE anti-friction layer.

The PTFE for use with the present invention is preferably a dispersion of fine particles in colloidal form. A preferred average particle size would be in the range of from about 0.05–3.0 micrometers (microns) and can be in any convenient nonaqueous media; e.g., synthetic or mineral base oil, compatible with the remainder of the formulation. Commercial PTFE dispersions which are suitable for the invention include ACHESON SLA 1612 manufactured by ACHESON COLLOIDS COMPANY, Michigan. U.S. Pat. No. 4,333,840 to Reick discloses a lubricant composition of PTFE in a motor oil carrier diluted with a major amount of a synthetic lubricant having a low viscosity and a high viscosity index.

The preferred dosage of PTFE in the total crankcase lubricant is from about 0.01 to about 10 weight %, more preferably from about 0.05 to about 5 weight %, and most preferably from about 0.1–3 weight % PTFE.

Borated Esters

A boron antiwear/extreme pressure agent, preferably a borate ester is hydrolytically stable and is utilized for improved antiwear, antiweld, extreme pressure and/or friction properties, and perform as a rust and corrosion inhibitor for copper bearings and other metal engine components. The borated esters act as an inhibitor for corrosion of metal to prevent corrosion of either ferrous or non-ferrous metals (e.g. copper, bronze, brass, titanium, aluminum and the like) or both, present in concentrations in which they are effective in inhibiting corrosion.

Boron acids include boric acid, boric esters, acid borates and the like. Boron compounds include boron oxide, boric acid and esters of boric acid. Patents describing techniques for making basic salts of sulfonic, carboxylic acids and mixtures thereof include U.S. Pat. Nos. 5,354,485; 2,501,731; 2,616,911; 2,777,874; 3,384,585; 3,320,162; 3,488,284; and 3,629,109. The disclosure of these patents are hereby incorporated by reference. Methods of preparing borated overbased compositions are found in U.S. Pat. Nos. 4,744,920; 4,792,410; and PCT publication WO 88/03144. The disclosure of these references are hereby incorporated by reference. The oil-soluble neutral or basic salts of alkali or alkaline earth metals salts may also be reacted with a boron compound.

The borate ester utilized in the preferred embodiment is manufactured by MOBIL CHEMICAL COMPANY under the product designation of ("MCP 1286"). Test data show the viscosity at 100 C using the D-445 method is 2.9 cSt; the viscosity at 40 C using the D-445 method is 11.9; the flash point using the D-93 method is 146; the pour point using the D-97 method is –69; and the percent boron as determined by the ICP method is 5.3%.

The preferred dosage of PTFE in the total crankcase lubricant is from about 0.01 to about 10 volume %, more preferably from about 0.05 to about 7 volume %, and most preferably from about 0.1–5.0 volume % PTFE.

Figure 6:
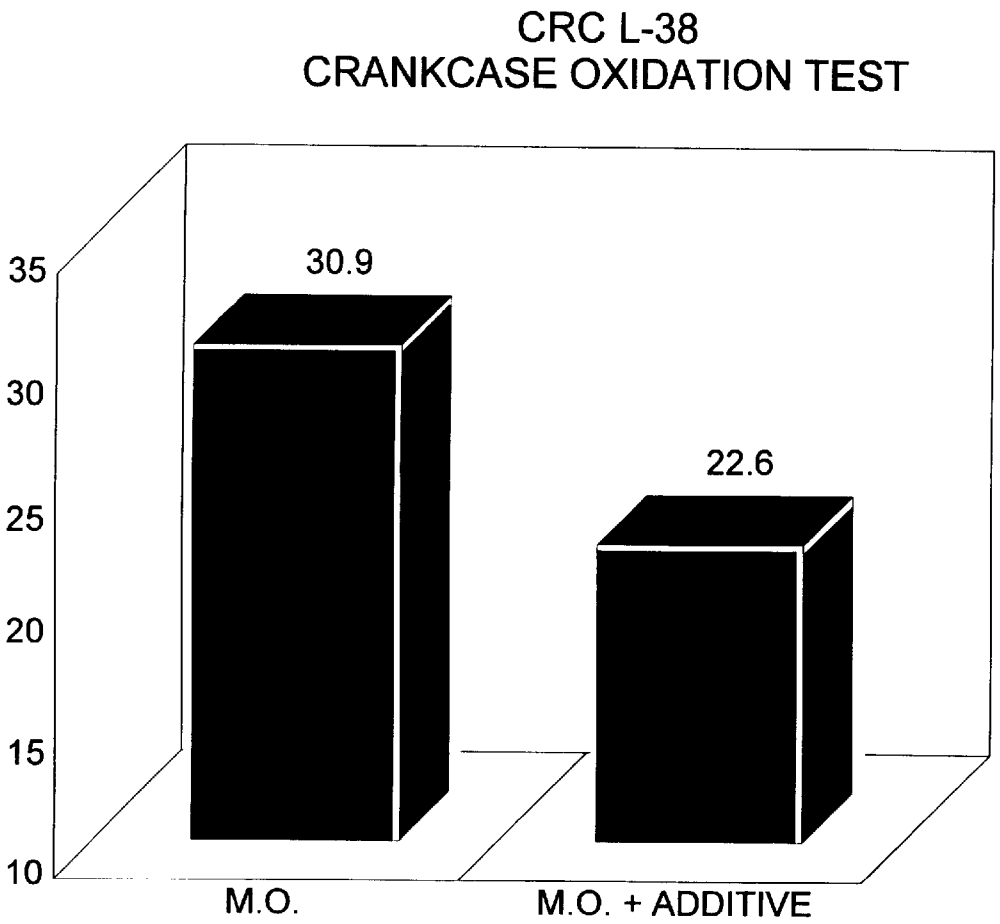
FIG. 6 graphs CRC L-38 Crankcase Oxidation Test and shows a 36.7% improvement from using the additive of the present invention including boric ester.

As demonstrated in FIG. 6, the engine treatment oil additive formulation was found to comply with all requirements of engine additives specification CRC L-38 for a Crankcase Oxidation Test showing the Total Adjusted Bearing Weight Loss comparing the synergistic blend of Components comprising the engine treatment oil additive with an API SG 5 w-30 Motor Oil. The surprisingly good results show the total adjusted bearing weight loss was reduced from 30.9 mg for the Motor Oil without the engine treatment oil additive to 22.6 mg. for the motor oil used in synergistic combination with the engine treatment oil additive.

The invention also contemplates the use of other additives in the lubricating and functional fluid compositions of this invention. Such additives include, for example, detergents and dispersants of the ash-producing or ashless type, corrosion and oxidation-inhibiting agents, pour point depressing agents, auxiliary extreme pressure and/or antiwear agents, color stabilizers and anti-foam agents.

Synergistic Effect

The novel engine treatment oil additive comprises a synergistic combination of chemical constituents including an oil soluble molybdenum additive, polyalphaolefin, ester such as a polyolester or diester, polytetrafluoroethylene, dispersant inhibitor containing zinc dithiophosphate, mineral oil base stock, and viscosity index improvers. A borate ester may also be incorporated in the blend providing an even greater improvement in the oxidation inhibition capabilities thereof. The synergistic blend is typically used in combination with a conventional crankcase lubricant at about a 20 to about a 25% volume/percent. The improved performance of the engine additive in comparison with conventional crankcase lubricants is attributable to the synergistic effect of optimizing the design parameters for each of the individual chemical constituents and combining the chemical constituents according to the present invention to obtain surprisingly good results including improved: wear, oxidation resistance, viscosity stability, engine cleanliness, fuel economy, cold starting, and inhibition of acid formation. The novel engine additive formulation comprises a synergistic combination of compounds, ingredients, or components, each of which alone is insufficient to give the desired properties, but when used in concert give outstanding lubricating properties.

It is theorized that the combination of chemical constituents comprising the instant invention provide a synergistic effect resulting in a reduction of friction between the moving parts of the engine so that in operation an extremely fine film of the chemical constituents is formed on the metal surfaces. At the high temperature and high pressure within the engine, the surface active ingredients react with the film continuously forming an extremely thin lubricating layer thereon having an extremely low coefficient of friction and wear even under extreme temperature and pressure providing superior lubrication during the start-up and running phase of the engine.

EXPERIMENTAL EVALUATION

The following Examples provide the results of tests performed comparing the synergistic combination of formula components of the present invention with conventional API SG motor oil. The Examples exemplify the technology previously described. The synergistic combination of the formula components in the Examples provide excellent performance at high temperatures while also maintaining excellent performance at moderately elevated temperatures and normal temperatures, as well as provide resistance to ferrous and copper corrosion, improved wear, oxidation resistance, viscosity stability, engine cleanliness, fuel economy, cold starting, inhibition of acid formation, and other desirable high performance properties greater than exhibited by the individual components.

EXAMPLE 1

(The Invention Using Mo. Synthetic, PTFE, DI and VI Additive)

An additive package, designated (TM), is designed for addition to conventional motor oil in the crankcase of an internal combustion engine is prepared in a 2000 gallon jacketed, stirred vessel heated to approximately 40° C. First there is added 600 gallons of polyalphaolefins (PAO 4 cSt) obtained from ETHYL CORPORATION under the trademark DURASYN 164; 43 gallons of PAO 6 centistoke DURASYN 166 obtained from the same source and 93 gallons of diester obtained under the brand name EMERY 2960. Stirring continues during the addition of all the ingredients. The above mixture is termed "synthetic" and is a synthetic base stock. To the synthetic is added 123 gallons of dispersant inhibitor (DI) package obtained under the brand name LUBRIZOL 8955 LUBRIZOL CORPORATION; 5 gallons of an 8% concentrate of SHELL VIS 1990 viscosity index improver, 25 gallons of MOLYVAN 855, obtained from R.T. VANDERBILT COMPANY, and 52 gallons of SLA 1612, y obtained from ACHESON COLLOIDS, a 20% concentration of colloidal DUPONT TEFLON® brand PTFE. The resulting mixture is stirred for an additional 30 minutes, sampled and tested for viscosity, metal concentration, and other quality control checks.

The resulting concentrate (TM) is bottled into one quart containers and a single container is added to the four quarts of conventional motor oil in a five quart crank case of an automobile.

Figure 2:
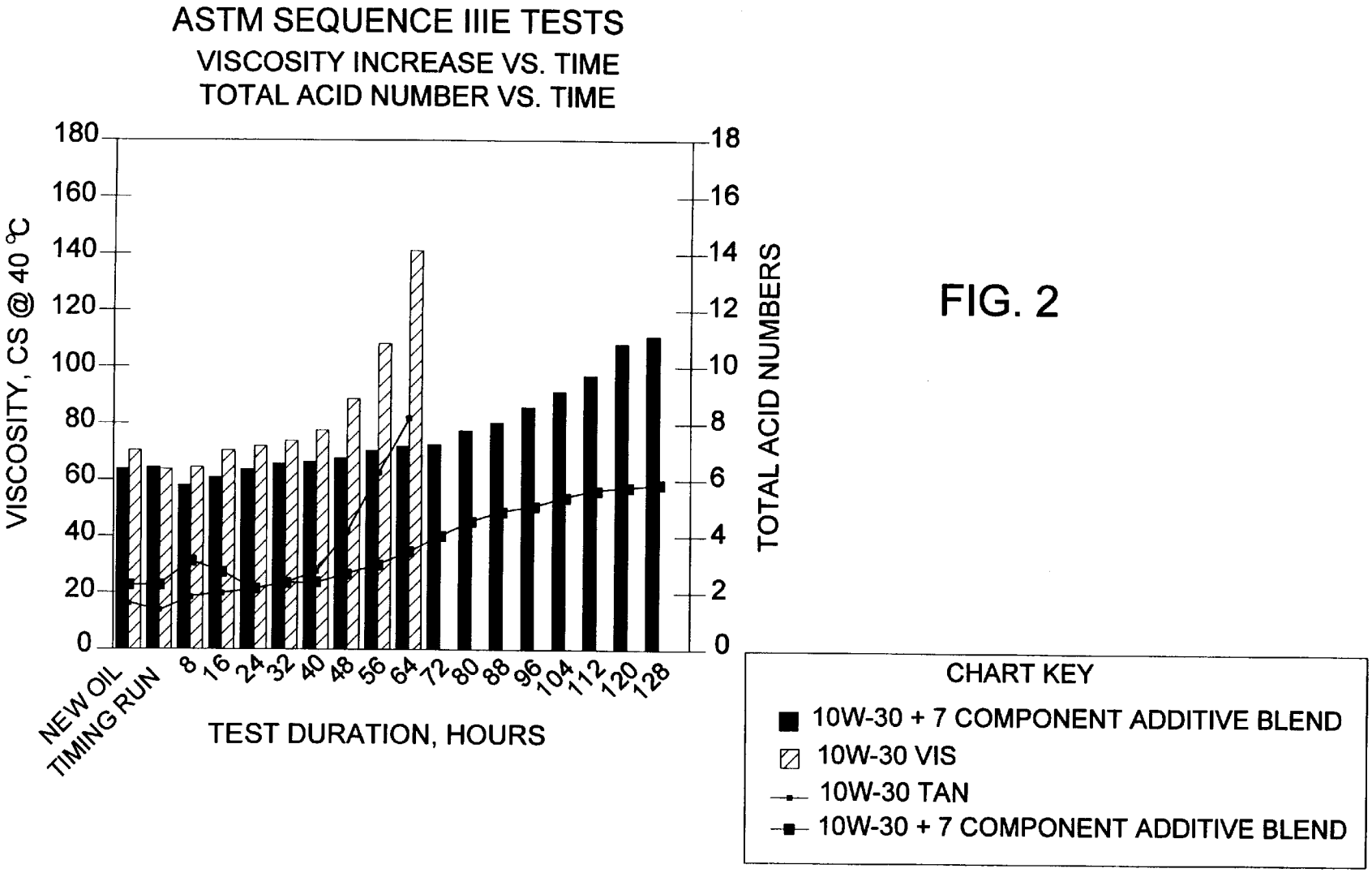
FIG. 2 is a multiple parameter graph of base oil compared to adiditized oil showing viscosity increase and acid number increase versus time in ASTM Sequence IIIE tests.
Figure 3:
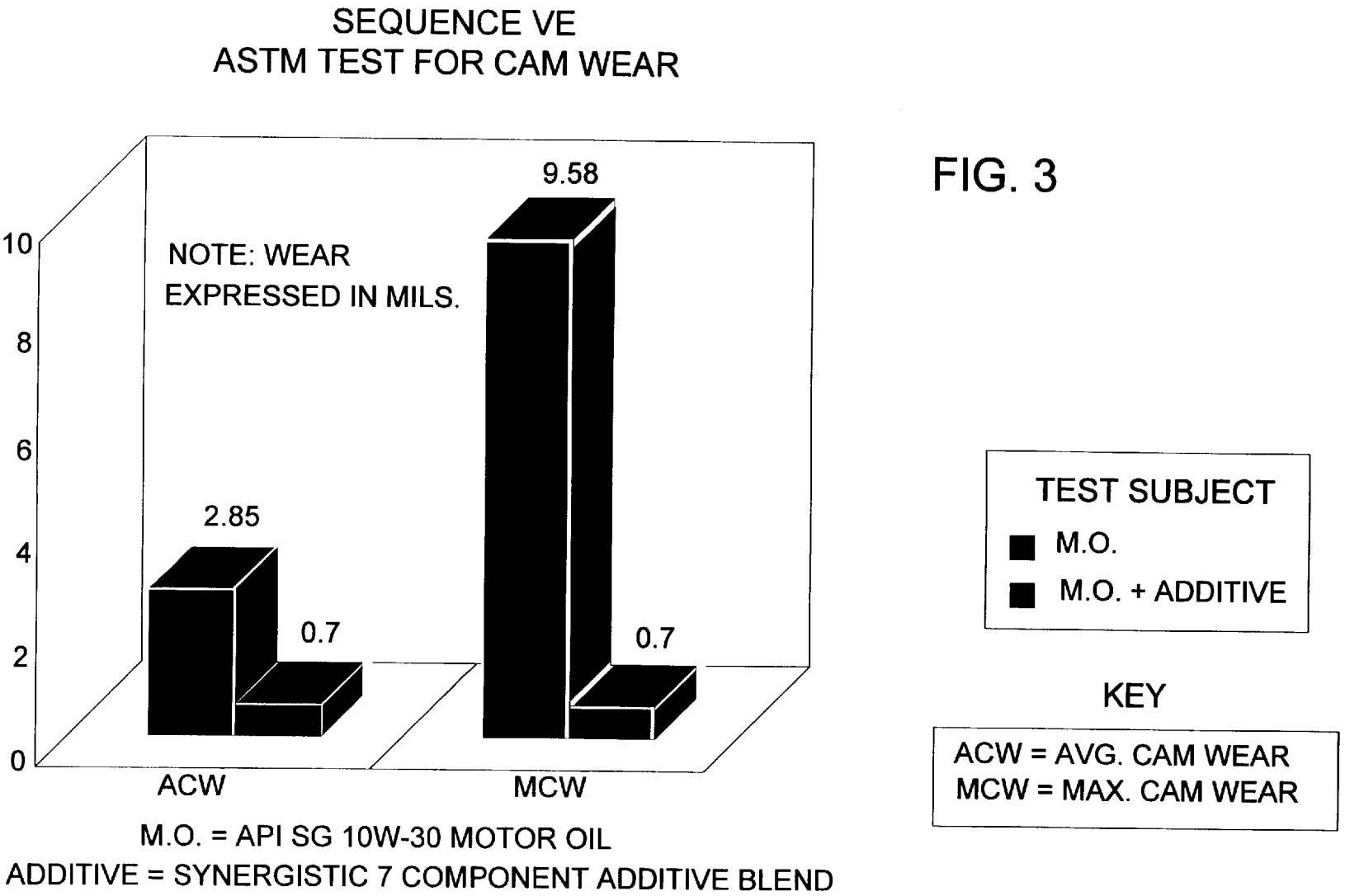
FIG. 3 graphs ASTM Sequence VE test results of average (and maximum) cam wear for oil including the additive of the present invention versus conventional motor oil.
Figure 4:
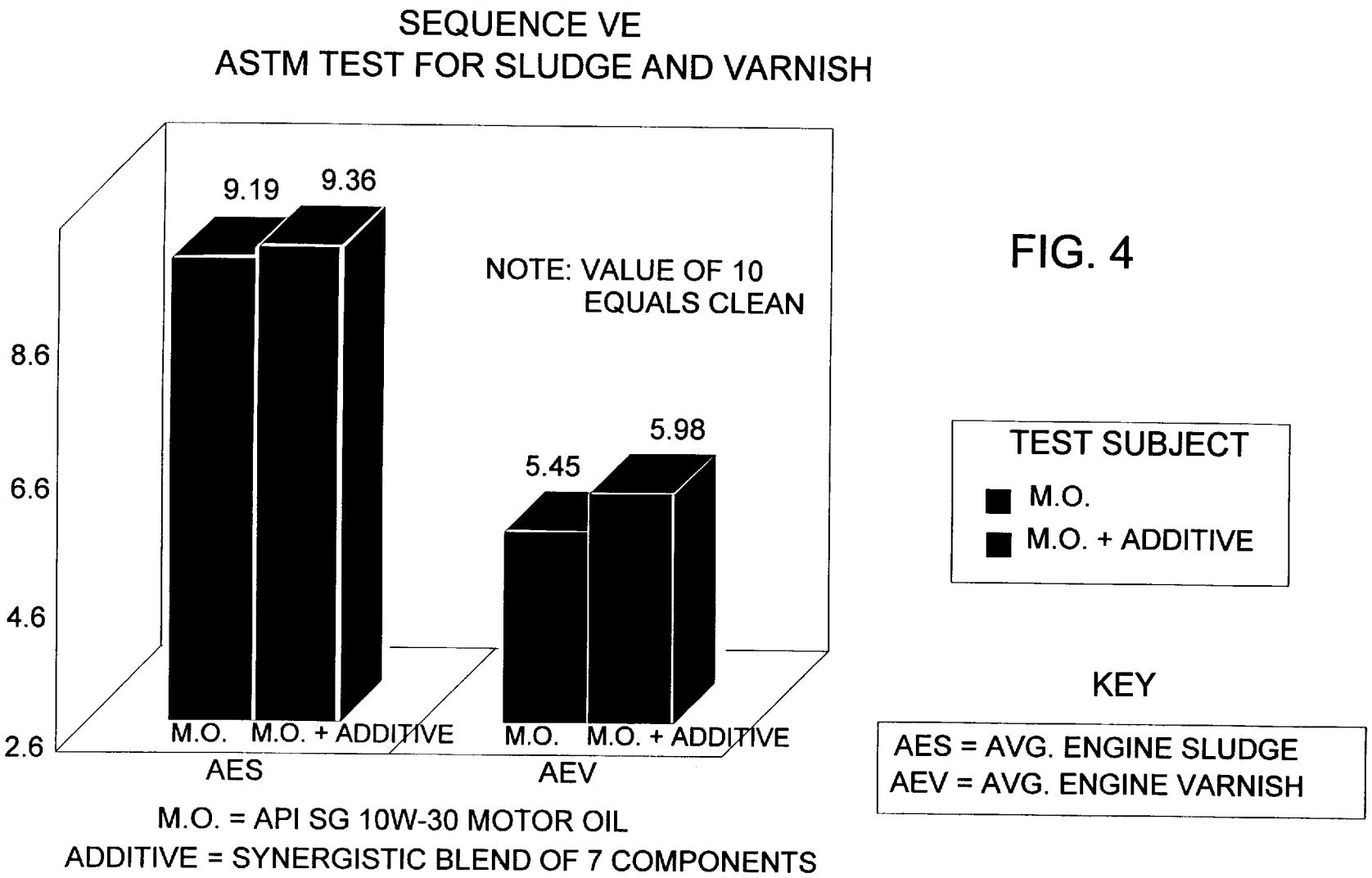
FIG. 4 graphs the substantial improvement in engine cleanliness in the Sequence VE test for the oil including the additive of the present invention versus conventional motor oil.
Figure 5:
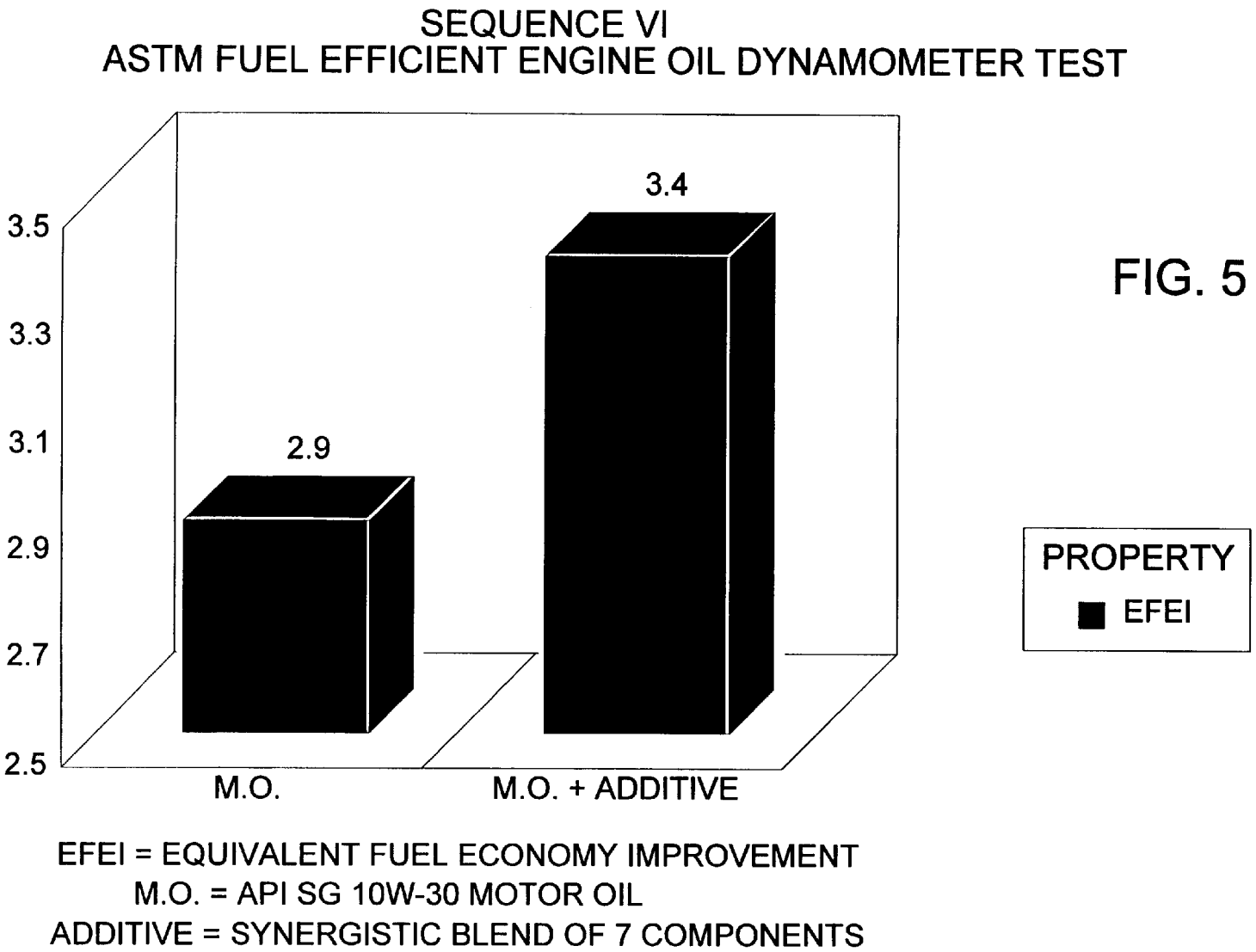
FIG. 5 graphs ASTM Sequence VI fuel economy and shows 17% improvement when using the additive of the present invention.

The result is improved wear (FIGS. 1 and 3), oxidation resistance (FIG. 2), viscosity stability (FIG. 2), engine cleanliness (FIG. 4), fuel economy (FIG. 5), cold starting (Table 2, and inhibited acid formation (FIG. 2).

EXAMPLE 2

(The Invention Under Standard Tests)

When one of the one quart formulations prepared in Example 1 is tested under conventional lubricant test procedures, results are as given in Tables 1 and 2, and FIGS. 1–5. Note that the Shell four-ball wear test ASTM D4172 of FIG. 1 and Table 1 is a bench test indicative of wear performance of a lubricant.

When the same ingredients of Example 1 are formulated while omitting one or more of the ingredients, the comparative results are as shown in Table 1 and FIG. 1.

TABLE 1

| | ASTM 4172 Shell Four Ball | | | | | | | | |
|---|---|---|---|---|---|---|---|---|---|
| TEST | AC | SYN | AC + SYN | AC + TEF | AC + MOLY | AC + SYN + TEF | AC + SYN + MOLY | AC + MOLY + TEF | AC + SYN + MOLY + VI + DI* |
| Shell Four-Ball Wear, mm | 0.405 | 0.360 | 0.373 | 0.422 | 0.330 | 0.375 | 0.332 | 0.335 | 0.308 |

MO Motor Oils, Valvoline 10W30 All-Climate

SYN Valvoline 5W30 Synthetic, includes DI and VI

AC + SYN 10W30 AC + )20%) 5W30 Synthetic

MOLY Molybdenum

TEF Teflon ®

Invention of Example 1

TABLE 2

| ASTM 4742 - 88 Oxidation | | | | | |
|---|---|---|---|---|---|
| Sample | RFOUT(min)** | TFOUT(min)* | Ruler*** | CCS@20 ° C. cP | TP1@20° F. cP |
| A | 180 | 138 | 211 | 3,030 | 12,540 |
| C | 370 | 279 | 322 | 2,160 | 9,360 |

Note: A 10W30 All Climate (Motor Oil Control)
*C 80% Control plus 20% Additive
**Thin Film Oxygen Uptake
***Modified test of ASTM 4742
Remaining useful Life Evaluation Routine As can be seen from Tables 1 and 2, and FIGS. 1 through 5, the results using this additive show a remarkable improvement when compared to a conventional motor oil tested without the additive of the invention.

EXAMPLE 3

The additive produced in Example 1 is added to cutting oils used in industrial milling machines, tapping machines, extruders, lathes, broaching, and gear hobbing, and the results indicate improved lubricity and longer life for both the cool and the lubricating fluid.

EXAMPLE 4

The grease composition according to the invention is conventionally mixed with a lithium soap of a fatty acid to thicken the composition, an improved grease showing the advantages of the invention results.

EXAMPLE 5

The additive produced in Example 1 and including a borate ester. As demonstrated in FIG. 6, the engine treatment oil additive formulation was found to comply with all requirements of engine additives specification CRC L-38 for a Crankcase Oxidation Test showing the Total Adjusted Bearing Weight Loss comparing the synergistic blend of Components comprising the engine treatment oil additive with an API SG 5 w-30 Motor Oil. The surprisingly good results show the total adjusted bearing weight loss was reduced from 30.9 mg for the Motor Oil without the engine treatment oil additive to 22.6 mg. for the motor oil used in synergistic combination with the engine treatment oil additive.

As set forth herebelow, Table 3 shows various additive combinations and the preferred formulas by weight and/or volume percent.

TABLE 3

| ADDITIVE COMPOSITIONS | | | | | |
|---|---|---|---|---|---|
| Parameter | Units | Preferred | More Preferred | Most Preferred | Target Formulation Vol. % |
| Synthetic Base Stock | Vol.% | 10–95 | 25–90 | 60–85 | 74 |
| Polyolefins | Vol.% | 15–85 | 25–80 | 50–75 | 65 |
| Diesters | Vol% | 1–25 | 3–20 | 5–15 | 9.5 |
| Viscosity Improver 100% | Wt. % | 0.05–5 | 0.07–3 | 0.1–2 | 6.5 |
| Molybdenum (Mo) | Wt. % | 0.05–5 | 0.07–3 | 0.1–2 | 2.5 |
| PTFE | Wt. % | 0.01–10 | 0.0005–5 | 0.1–3 | 20 |
| Dispersant (12.3% vol.) | Vol.% | 0..5–35 | 1–25 | 5–20 | 12.3 |
| Dilution Before Use: | Vol. Lubr. Vol. Addit | 0.25 | 0.5–15 | 1–10 | 4–5 |
| Borate Esters | Vol.% | 0.01–10 | 0.05–7 | 0.1–5 | 1 |

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

Reference to documents made in the specification is intended to result in such patents or literature cited are expressly incorporated herein by reference, including any patents or other literature references cited within such documents as if fully set forth in this specification.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented hereinabove. Rather, what is intended to be covered is within the spirit and scope of the appended claims.

We claim:

1. An engine treatment oil additive used in combination with a conventional crankcase lubricant at about a 20 to about a 25% volume/percent comprising a synergistic combination of chemical constituents, said concentrate comprising:

from 0.05 weight percent to 5.0 weight percent of an oil soluble molybdenum additive;

from 10.0 volume percent to 95 volume percent of a polyalphaolefin;

from 10.0 volume percent to 95 volume percent of an ester;

from 0.01 weight percent to 10.0 weight percent of a nonaqueous polytetrafluoroethylene;

from 0.5 volume percent to 35.0 volume percent of a dispersant inhibitor;

from 5.0 volume percent to 95.0 volume percent of a mineral oil base stock;

from 0.5 weight percent to 25.0 weight percent of a viscosity index improver; and from 0.01 volume percent to 10.0 volume percent of a borate ester.

2. The concentrate according to claim 1, comprising:

a. 1.0 to 3.0 weight percent of said oil soluble molybdenum additive; and b. 0.5 to 3 weight percent of said polytetrafluoroethylene.

3. The concentrate according to claim 1 wherein the synthetic base stock comprises at least 10% polyalphaolefins.

4. The concentrate according to claim 1 wherein said nonaqueous polytetrafluoroethylene comprises a colloidal-dispersed nonaqueous polytetrafluoroethylene.

5. The concentrate according to claim 1 wherein said dispersant inhibitor containing zinc dithiophosphate.

6. The concentrate according to claim 1 wherein said viscosity index improver comprises polyisobutenes, polymethacrylate acid esters, polyacrylate acid esters, diene polymers, polyalkyl styrenes, alkenyl aryl conjugated diene copolymers and/or polyolefins.

7. The concentrate according to claim 1, wherein said ester is a polyol ester.

8. The concentrate according to claim 1, wherein said ester is a diester.

9. The concentrate of claim 8, including a borate ester.

10. The concentrate of claim 8, including a synthetic oil base stock comprising from 10.0 to 95.0 volume percent of at least one polyol ester and from 10.0 to 95.0 volume percent of at least one polyalpholefin.

11. A lubricating concentrate comprising a major amount of an oil of lubricating viscosity and a minor amount of the concentrate of claim 1.

12. A concentrate for dilution with conventional and/or synthetic motor oil comprising in combination:

a. 0.35–15 weight percent of oil soluble molybdenum additive;

b. 0.25–25 weight percent of nonaqueous polytetrafluoroethylene;

c. 10.0–95.0 volume percent of synthetic base stock; and d. 0.35–25 weight percent of viscosity index improver.

13. A lubricating concentrate comprising a major amount of an oil of lubricating viscosity and a minor amount of the concentrate of claim 12.

14. A process of manufacturing an improved lubricating concentrate additive comprising the steps of mixing together at about 0–100° C.:

a. 0.35–15 weight percent of oil soluble molybdenum additive;

b. 0.25–25 weight percent of polytetrafluoroethylene; together with conventional and/or synthetic motor oil or grease;

c. 10–95 vol. weight percent of synthetic base stock comprising diesters and/or polyolefins; and d. 0.5–15 weight percent of viscosity index improver.

15. The process of manufacturing an improved lubricating concentrate of claim 14, including the step of mixing together at 0–100° C. from 0.5–35 vol. % of a dispersant inhibitor.

16. The process of manufacturing an improved lubricating concentrate of claim 14, including the step of mixing together at 0–100° C. from 0.5–35 volume percent of a borate ester.

17. The process of manufacturing an improved lubricating concentrate of claim 14, including the step of mixing together at 0–100° C. from 0.5–35 volume percent of a mineral oil base stock.

18. A lubricating concentrate additive used in combination with a conventional crankcase lubricant at from about a 20 to about a 25% volume/percent comprising:

a. 0.35–15 weight percent of oil soluble molybdenum additive;

b. 0.25–25 weight percent of nonaqueous polytetrafluoroethylene;

c. 5–95 volume percent of mineral oil base stock; and d. 0.5–15 weight percent of viscosity index improver.

19. A lubricating concentrate comprising a major amount of an oil of lubricating viscosity and a minor amount of the concentrate of claim 18.

20. An engine treatment oil additive concentrate used in combination with a conventional crankcase lubricant at about a 20 to about a 25% volume/percent comprising a synergistic combination of chemical constituents comprising:

from 0.05 weight percent to 5.0 weight percent of an oil soluble molybdenum additive;

from 0.01 weight percent to 10.0 weight percent of a nonaqueous a polytetrafluoroethylene;

from 0.5 volume percent to 35.0 volume percent of a dispersant inhibitor;

from 5.0 volume percent to 95.0 volume percent of a mineral oil base stock; and from 0.5 weight percent to 25.0 weight percent of a viscosity index improver.

21. A lubricating concentrate comprising a major amount of an oil of lubricating viscosity and a minor amount of the concentrate of claim 20.

22. A lubricant concentrate for dilution with conventional and/or synthetic motor oil comprising in combination:

a. from 0.05 weight percent to 5.0 weight percent of an oil soluble molybdenum additive;

b. from 0.01 weight percent to 10.0 weight percent of a nonaqueous polytetrafluoroethylene;

c. from 10.0 volume percent to 95.0 volume percent of a synthetic base stock;

d. from 0.35 weight percent to 25.0 weight percent of a viscosity index improver; and e. from 0.5 volume percent to 35.0 volume percent of a dispersant inhibitor.

23. The lubricant concentrate of claim 22, including from 5.0 volume percent to 95.0 volume percent of a mineral oil base stock.

24. The lubricant concentrate of claim 22, wherein said synthetic base stock comprises polyol esters and/or polyalphaolefins.

25. The lubricant concentrate of claim 24, wherein said polyol esters comprises at least one diester.

26. The lubricant concentrate of claim 25, wherein said diester is a di-aliphatic diesters of alkyl carboxylic acid.

27. The lubricant concentrate of claim 25, wherein said di-aliphatic diesters of alkyl carboxylic acid is selected from the group consisting of di-2-ethylhexylazelate, di-isodecyladipate, and ditridecyladipate.

28. The lubricant concentrate of claim 22, wherein said synthetic base stock is a mixture of at least one diester with at least one polyalphaolefin.

29. The lubricant concentrate of claim 24, wherein said polyol ester has a pour point of less than −100° C. to −40° C. and a viscosity of from 2 to 460 centistoke at 100° C.

30. The lubricant concentrate of claim 24, wherein said polyalphaolefin has a viscosity of from 2 to 460 centistoke at 200° C.

31. The lubricant concentrate of claim 24, wherein said polyalphaolefin has a viscosity of from 2 to 10 centistoke at 200° C.

32. The lubricant concentrate of claim 24, wherein said polyalphaolefin has a viscosity of from 4 to 6 centistoke at 200° C.

33. The lubricant concentrate of claim 22, wherein said synthetic base stock comprises from 25 to 90 percent by volume.

34. The lubricant concentrate of claim 22, wherein said synthetic base stock comprises from 60 to 85 percent by volume.

35. The lubricant concentrate of claim 22, wherein said viscosity index improver constitutes from 0.05 to 5.0 weight percent of the crankcase motor oil.

36. The lubricant concentrate of claim 22, wherein said viscosity index improve constitutes from 0.07 to 3.0 weight percent of the crankcase motor oil.

37. The lubricant concentrate of claim 22, wherein said viscosity index improve constitutes from 0.1 to 2.0 weight percent of the crankcase motor oil.

38. The lubricant concentrate of claim 22, wherein said oil soluble molybdenum additive is an organo molybdenum compound.

39. The lubricant concentrate of claim 38, wherein said organo molybdenum compound is selected from the group consisting of sulfonated oxymolybdenum dialkyldithiophosphate, and sulfide molybdenum dithiophosphate.

40. The lubricant concentrate of claim 22, wherein said oil soluble molybdenum additive is an inorganic molybdenum compound.

41. The lubricant concentrate of claim 40, wherein said inorganic molybdenum compound is selected from the group consisting of molybdenum sulfide and molybdenum oxide.

42. The lubricant concentrate of claim 22, wherein said nonaqueous polytetrafluoroethylene comprises from 0.25 to 10.0 weight percent of the total crankcase lubricant.

43. The lubricant concentrate of claim 22, wherein said nonaqueous polytetrafluoroethylene comprises from 0.05 to 5.0 weight percent of the total crankcase lubricant.

44. The lubricant concentrate of claim 22, wherein said nonaqueous polytetrafluoroethylene comprises from 0.1 to 3.0 weight percent in the total crankcase lubricant.

45. The lubricant concentrate of claim 22, said dispersant inhibitor containing zinc dithiophosphate.

46. The lubricant concentrate of claim 22, wherein said dispersant inhibitor is selected from the group consisting of alkyl zinc dithiophosphates, succinimide, Mannich dispersants, or combinations thereof.

47. The lubricant concentrate of claim 22, wherein said dispersant inhibitor comprises from 0.5 to 35.0 by volume of the total crankcase formulation.

48. The lubricant concentrate of claim 22, wherein said dispersant inhibitor comprises from 1.0 to 25.0 by volume of the total crankcase formulation.

49. The lubricant concentrate of claim 22, wherein said dispersant inhibitor comprises from 5.0 to 20.0 by volume of the total crankcase formulation.

50. A lubricating concentrate comprising a major amount of an oil of lubricating viscosity and a minor amount of the composition of claim 22.

* * * * *